US005509837A

United States Patent [19]

Allbright, Jr. et al.

[11] Patent Number: 5,509,837

[45] Date of Patent: Apr. 23, 1996

[54] TRUSS SYSTEM ENGINE MOUNT FOR LIGHT WATERCRAFT

[76] Inventors: Walter E. Allbright, Jr., 321 Magnolia La., Covington, La. 70433; Tim Nowlin, 6815 Club Ridge Cir. 220, Memphis, Tenn. 38115

[21] Appl. No.: 318,281

[22] Filed: Oct. 5, 1994

[51] Int. Cl.[6] ..... B63H 21/30

[52] U.S. Cl. ..... 440/111; 248/659

[58] Field of Search ..... 440/111, 112; 248/637, 638, 659

[56] References Cited

U.S. PATENT DOCUMENTS 4,193,370 3/1980 Schoell ..... 114/56

FOREIGN PATENT DOCUMENTS 56163998 12/1981 Japan ..... 440/111
478347 3/1992 Japan ..... 248/637

*Primary Examiner*—Sherman Basinger
*Attorney, Agent, or Firm*—Joseph T. Regard, Ltd.

[57] ABSTRACT

An engine mount for supporting an inboard powerboat engine on a light marine craft. The present invention teaches an inboard, truss engine mount for marine engines, tailored for supporting the weight of the engine in spaced, transverse fashion along weight distributing supports situated along the chines of the watercraft. The present invention is particularly suitable for use in mounting an inboard engine in conjunction with lightweight aluminum boats traditionally referred to as skiffs of flatboats, which typically are of a length of about 7–22 feet. The present system allows the utilization of inboard engines with a boat which traditionally relied upon outboard engines affixed to the transom, as the weight of inboard engines could not be supported by the floor of the light weight boats. However, the present system overcomes this problem, by distributing the weight in a novel fashion, while taking advantage of the relative strength and rigidity of the chines in this type of watercraft. In addition to support placement and weight distribution members, the present system also contemplates the utilization of shock absorption members, including bushings, springs, or the like to further lessen stress on the supporting watercraft, while reducing vibration and noise characteristics during operation.

4 Claims, 3 Drawing Sheets

TRUSS SYSTEM ENGINE MOUNT FOR LIGHT WATERCRAFT

BACKGROUND OF THE INVENTION

1. Invention Field

The present invention relates to an engine mount for supporting an inboard power boat engine on a light marine craft.

More specifically, the present invention teaches an inboard, truss engine mount for marine engines, tailored for supporting the weight of the engine in spaced, transverse fashion along weight distributing supports situated along the chines of the watercraft.

The present invention is particularly suitable for use in mounting an inboard engine in conjunction with lightweight aluminum boats traditionally referred to as flat boats or skiffs, which typically are of a length of about 7–22 feet.

The present system allows the utilization of inboard engines with a boat which traditionally relied upon outboard engines affixed to the transom, as the weight of inboard engines could not be supported by the floor of the light weight boats. However, the present system overcomes this problem, by distributing the weight in a novel fashion, while taking advantage of the relative strength and rigidity of the chines in this type of watercraft.

In addition to support placement and weight distribution members, the present system also contemplates the utilization of shock absorption members, including bushings, springs, or the like to further lessen stress on the supporting watercraft, while dampening vibration and noise characteristics during operation.

2. General Background Discussion

While the prior art has contemplated various and diverse systems for supporting inboard marine engines in watercraft, none are believed to contemplate the present system, which is tailored to supporting a relatively heavy marine engine in a light weight water craft, such as a lightweight aluminum fishing boat, whose floor may be too weak for supporting same.

The following patents were found to have at least some general pertinence to the present invention, most teaching systems for supporting or mounting inboard marine engines:

| Patent Number | Inventor(s) | Date of Invention |
|---|---|---|
| 4,778,421 | Greenburg | 10/18/88 |
| 5,211,592 | Alkema | 05/18/93 |
| 3,845,923 | Atkinson | 11/05/74 |
| 5,069,414 | Smith | 12/03/91 |
| 4,778,420 | Greenburg | 10/18/88 |
| 3,083,697 | Walford | 04/02/63 |
| 3,834,344 | Yoshino | 09/10/74 |
| 5,265,554 | Meredith | 11/30/93 |
| 5,259,331 | Hagan | 11/09/93 |
| 5,022,628 | Johnson et al | 06/11/91 |
| 4,666,412 | Rawlings | 05/19/87 |
| 4,747,360 | Tuncel et al | 05/31/88 |
| 3,918,387 | Jobst | 11/11/75 |
| 4,003,330 | Compton | 01/18/77 |
| 3,583,357 | Schmanckes | 08/08/71 |

U.S. Pat. No. 4,778,421 issued 1988 to Ray Industries of Tennessee teaches an "engine bed for inboard-powered boats" specifically tailored for a powerboat hull with stringers, contemplates the supporting of a marine inboard engine comprising a support distributing the weight of the engine in spaced, transverse fashion upon longitudinally situated stringers along the floor of the craft.

U.S. Pat. No. 5,211,592 issued 1993 to Malibu Boats of California teaches an "Engine Mount System and Method for Boats" likewise contemplates a support for a marine engine transversely distributing the weight to the stringers; unlike the '421 patent and searched for invention, further, this patent is further distinguishable as it relies upon stringers spaced roughly the width of the engine to be supported, and the mount is configured to lay upon the hull, distributing the weight of the engine accross the hull along the length of the mount.

The remaining cited patents teach engine mounts for marine engines, vibration reducing means, and drive configurations of some general pertinence to the present, applied for invention.

Thus, while the patents cited above teach various and diverse methods for mounting inboard engines in marine craft, none of these systems are suitable for use in conjunction with thin walled, lightweight boats which have traditionally relied upon outboard motors.

SUMMARY DISCUSSION OF THE INVENTION

The present invention overcomes these prior art problems by providing an inboard engine truss support mount suitable for use in conjunction with lightweight water craft, which is not only effective in distributing the weight of the engine, but is also cost effective and requires little in the way of maintenance once installed.

As shown in the prior art, boats utilizing inboard propulsion must be constructed such that the static as well as dynamic forces of the propulsion units are supported by the structure. Boats have traditionally utilized stringers, longitudinally aligned structural members situated along the length of the structure, to distribute the weight of the engine. However, stringers add to the weight and cost of the craft, and are not practical for use in conjunction with some boats, including aluminum skiffs and the like, which have relatively thin walls forming the hull.

As such, it is not advantageous to mount an engine upon the hull of light weight water craft designed for outboard power, such as flat boats or skiffs; even if stringers were provided and utilized, the hull thickness would not be sufficient to sustain utilization of an inboard propulsion arrangement, as vibration and the dynamic forces of operation would stress the hulls to failure.

Further, the hull skin of such watercraft is designed to be dynamic, absorbing energy by flexing, which is a desirable component for utilization with outboard propulsion, which is mounted upon the transom. As such, stringers are not desirable, as they would prevent such flexing.

Instead of supporting the inboard engine upon the hull, as with prior art systems, the present invention supports the engine suspended above the hull, relying upon the chines to distribute and support the weight of the engine.

Not only does the present system effectively support the inboard propulsion system in lightweight watercraft heretofore not possible, it also provides a motor mount and support system which effectively isolates vibration from the boat, as well as absorbing shock. Further, the present system does not interfere with the flexing of the hull skin, allowing the light weight watercraft to perform as designed, effectively absorbing wave energy in the hull flexing process, and isolating that energy from the occupants of the craft.

The preferred embodiment of the present invention teaches a three part system, comprising the mounting brackets configuration and placement in the vicinity of the chines, the general structural configuration of first and second sets of transversal support members, and lastly, the front and rear engine mounts.

It is thus an object of the present invention to provide an effective system for supporting an inboard marine engine in lightweight boats designed for outboard power.

It is another object of the present invention to provide a system for mounting an inboard marine engine in a lightweight boat so as to not interfere with the flexing of the hull.

Further, it is an object of the present invention to provide a system for mounting an inboard marine engine on a lightweight boat which effectively isolates vibration and provides a sustainable center of gravity for operating a propulsion system with a relatively heavy motor.

It is another object of the present invention to provide an engine mount for mounting an inboard marine engine in a manner which provides enhanced weight distribution and structural integrity when compared to prior art systems.

It is another object of the present invention to provide an engine mount for mounting an inboard marine engine in a manner which is relatively inexpensive and which requires little maintenance.

Lastly, it is an object of the present invention to provide an engine mount system for mounting an inboard marine engine to a lightweight water craft which is adaptable to a variety of boat configurations and requirements.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE INVENTION

Figure 1:
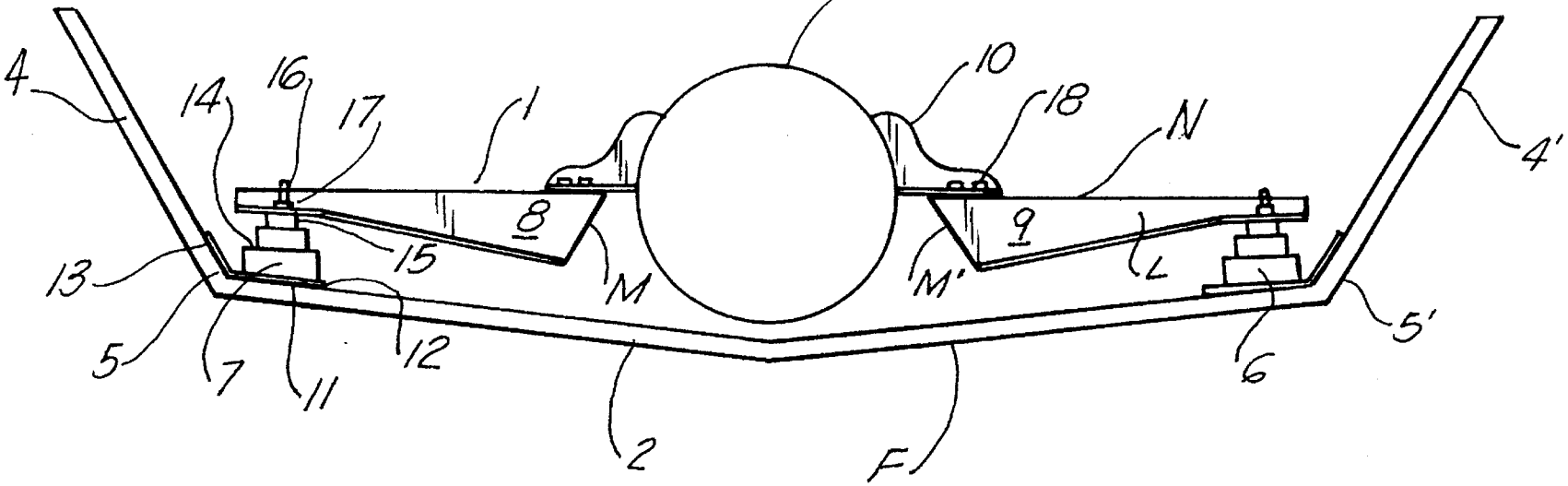
FIG. 1 is a rear view of the truss support system of the present invention, illustrating the placement and configuration of the mounting brackets relative to the chines, the transversal support members, and support of the engine relative to the hull for the rear engine support.

Referring to FIG. 1, the truss support system 1 of the present invention is mounted in a lightweight watercraft such as an aluminum flatboat F or the like, having a shallow hull 2. As shown, the present system supports a marine engine 3 in general longitudinal alignment with the hull, just above the center areal, maintaining a low center of gravity for stability, in this case, such that the oil pan is situated below the support beams.

The watercraft exemplified in FIG. 1 has emanating from the hull 2 first and second sidewalls 4, 4', respectively, which provide significant rigidity to the construction of the craft.

Juxtaposed the hull and sidewalls are the chines 5, 5', which are utilized in the present invention to support and distribute the weight of the engine, via the truss support system disclosed herein.

As shown, interfacing the chines, hull, and sidewalls on opposing, distal sides of the craft are first 6 and second 7 mounting brackets, which in turn support first 8 and second 9 transversal support beams, supporting engine 3 via engine mount 10. Each mounting bracket is comprised of a bracket base pad 11, which is preferably angled so as to communicate 13 with the chines, sidewalls, and hull of the craft, and which preferably is welded or otherwise joined to the structure of the craft upon which it is mounted.

Situated upon that part of the base pad above the hull 12 spacer member 14, configured to elevate the support beams to in turn elevate the supported engine at the appropriate position above the hull. The spacer members may be formed of, for example, steel, or may comprise, in utilization with lighter engines, a rigid rubber compound of the like, for shock and vibration absorption.

Situated atop the spacer member 14 in the present, exemplary embodiment of the invention is a rubber bushing 15 for providing shock and vibration absorption, which bushing may be dispensed when the spacer member is formed of rigid rubber or the like.

Threadingly affixed to the spacer member 14 via nut 17 and bolt 16 arrangement or the like at opposing ends of the craft are first 8 and second 9 transversal support beams, each beam having lateral l and horizontal h faces for strength, each of said first and second transversal support beams situated to generally converge along a common axis over the generally central longitudinal axis of the hull, wherein their opposing ends are threadingly affixed 18 to the engine mount 10, supporting the front or rear of engine 3.

As shown in the exemplary embodiment of FIG. 1, the transversal support beams are configured such that the width of the lateral l face tapers from narrow, at the point of connection to the mounting brackets 6, 7 to wide, at the mounting of the engine mount at the beams medial ends M, M'. In fact, although the taper in the figure is illustrated as being towards the hull, it can be away from the hull, as well, as shown on the front engine mount 19 in FIG. 2.

This tapered lateral face feature, coupled with the generally untapered, horizontal face, has been found to provide a strong mount, while allowing some flexing of the support beams, in order to compensate for dynamic forces during operation, while dampening the noise and vibration of the engines.

The beams of the present exemplary embodiment of the invention are composed of, for example, 5/16" steel, with varying thicknesses and materials, depending upon the size of the craft and weight of the engine to be supported.

Figure 2:
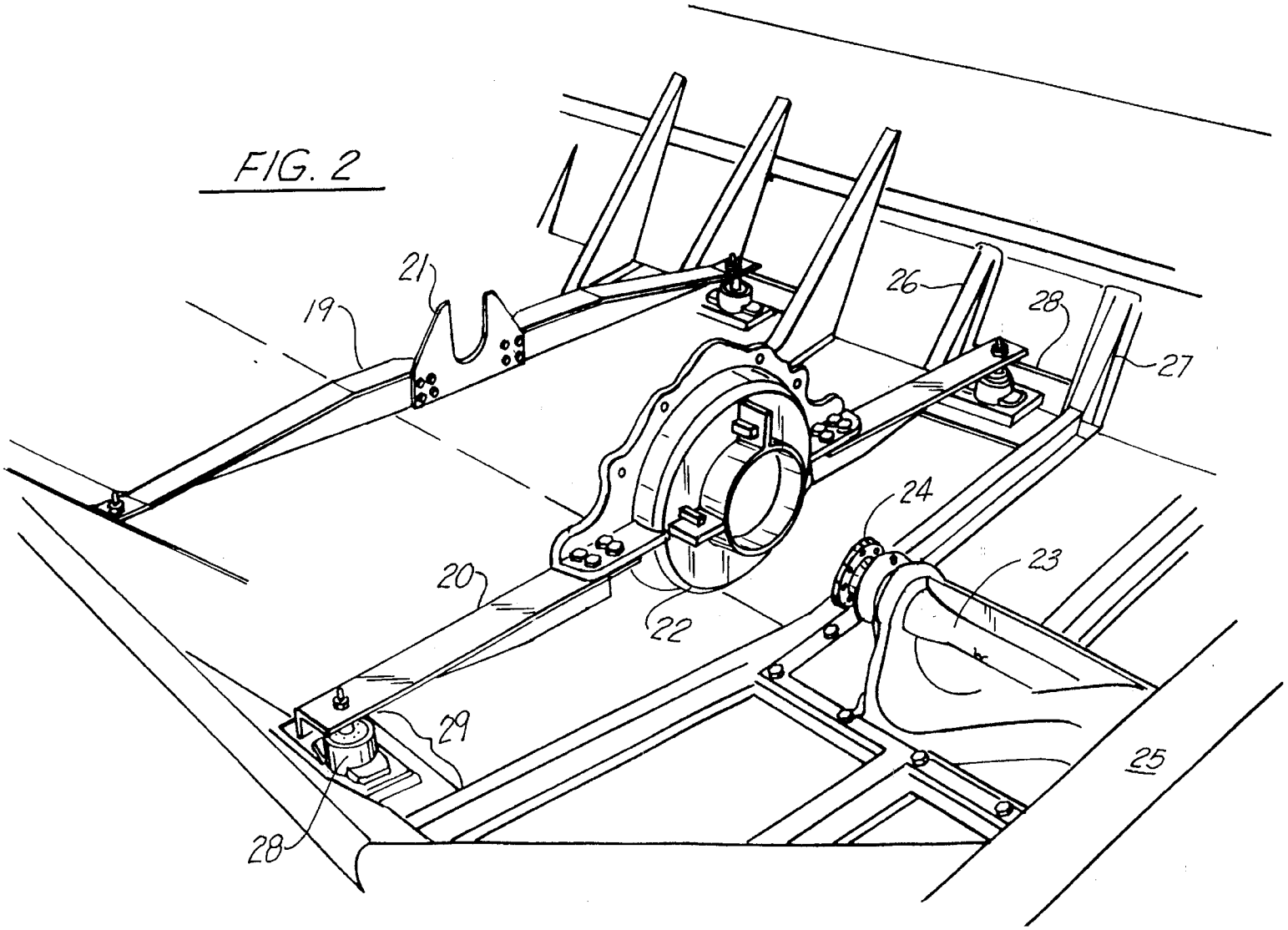
FIG. 2 is an isometric view of the truss support system of FIG. 1, illustrating the placement of the front and rear truss supports relative to an exemplary engine, the hull, chines, and transom of a lightweight water craft.

FIG. 2 illustrates an isometric view or the front and rear truss support systems of the present invention, supporting the front and rear ends of an engine, respectively. As shown, the front 21 and rear 22 engine supports are configured to align the engine with the drive shaft 24, situated in the drive housing 23, for passage through the transom 25.

The rear engine mount 22 of the exemplary embodiment utilizes the flywheel bell housing, with an alignment face, to provide secure support of the heavier end of the engine and drive train components.

Also illustrated in FIG. 2 is lateral support ribs 26, 27, which may be advantageous when utilizing the present system to support relatively heavy engines in light watercraft. As shown, the mounting brackets 28, 29 are situated between the lateral support ribs 26, 27, thereby providing enhanced structural integrity, as desired.

Figure 3:
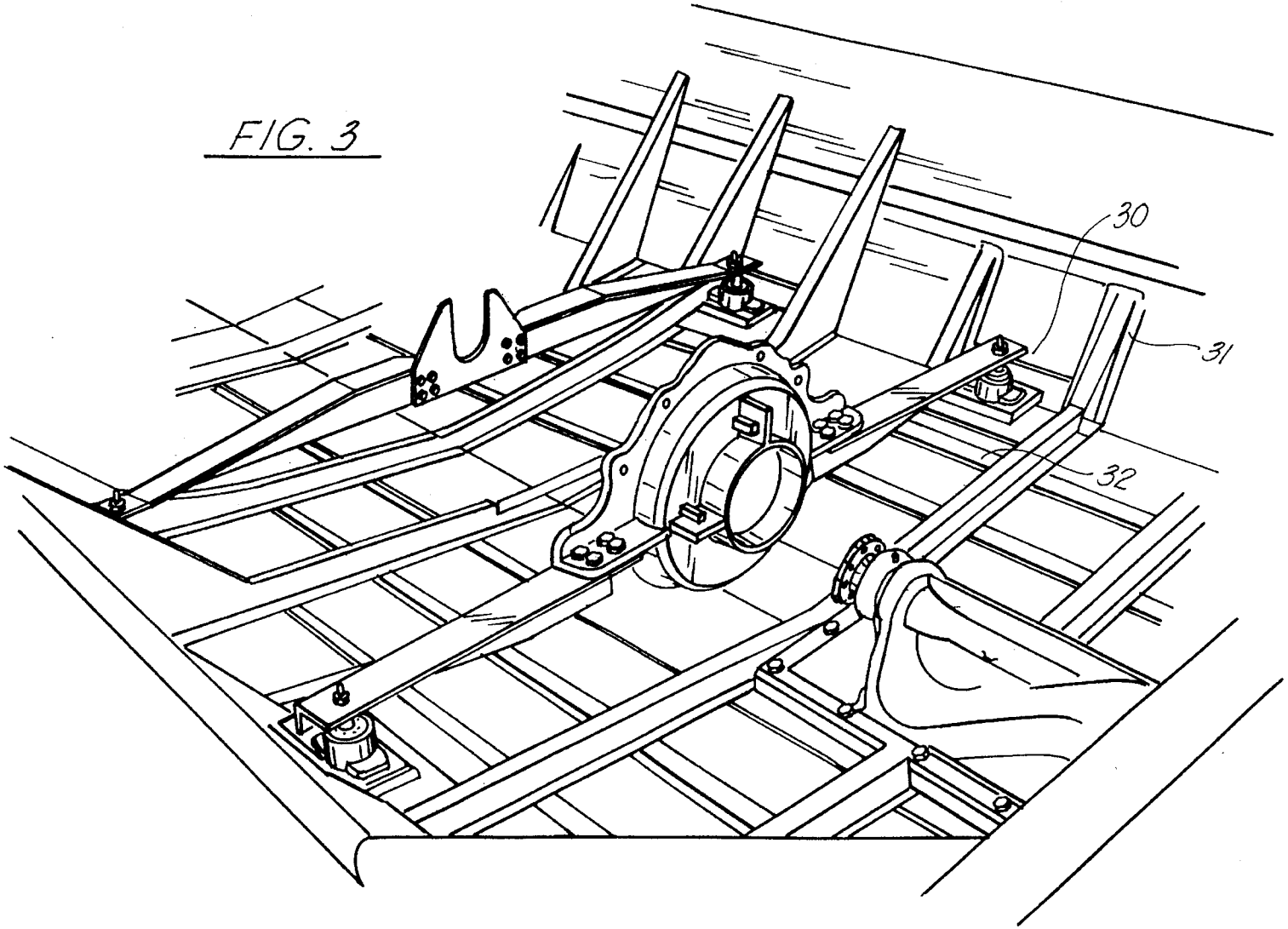
FIG. 3 is an isometric view of the truss support system of FIG. 1, illustrating the system of the present invention utilized in conjunction with a hull having longitudinal ribs employed therein.

Lastly, FIG. 3 illustrates a watercraft having lateral 31 ribs adjacent to the mounting brackets, as well as longitudinal ribs 32 spaced in longitudinally aligned fashion along the hull floor, and may be formed in the hull itself in a thin hulled boat fabricated of, for example, aluminum, for added structural integrity, while allowing for some hull flexing.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. A truss support system for mounting an inboard powerboat engine to a light marine craft having a hull having a longitudinal axis, the hull having side walls formed at opposing sides forming opposing chines, the chines juxtaposed the side walls and hull, the truss support comprising:

at least one beam support transversely situated relative to the longitudinal axis of said hull, said beam support having a mid-portion and two opposing end portions, said mid portion forming an engine mount means for mounting an engine, said engine mount means suspended above the longitudinal axis of the hull, so as to support said engine in spaced relationship above said hull, each of said opposing end portions being situated in spaced relationship above one of said opposing chines, and mounting means for mounting each of said opposing end portions to one of said chines in spaced relationship thereto, said mounting means further comprising a mounting bracket having a bracket base pad, said bracket base pad angled for bonding to both of a juxtaposed chine and side wall of said hull, a spacer member affixed to said bracket base pad, connection means for removeably connecting the distal end of said support beam to said mounting bracket, and dampening means juxtaposed said connection means and said bracket base pad, said dampening means for shock and vibration absorption.

2. The truss support system of claim 1, wherein there is provided first and second beam supports, and wherein said engine mount means comprises first and second engine mount elements associated with said first and second beam supports, respectively, said first and second engine mount elements configured to accept the front and rear ends of an engine, respectively, each of said first and second transversal beam supports situated so as to generally converge along a common axis over the generally central longitudinal axis of said hull.

3. The truss support system of claim 1, wherein said mid portion of said beam support has affixed thereto first and second transversal support beams emanating in opposing directions, forming first and second end portions at their respective distal ends, and first and second medial end portions at their respective medial ends.

4. The truss support system of claim 3, wherein said transversal support beams each have lateral and horizontal faces, said lateral and horizontal faces configured such that the width of said lateral face tapers from narrow, at said distal ends, to wide, at said medial end portions.

* * * * *